US005176301A

United States Patent [19]

Bert

[11] Patent Number: 5,176,301

[45] Date of Patent: Jan. 5, 1993

[54] NON-EXPANSIBLE WRIST BAND SEGMENT

[75] Inventor: Stephen F. Bert, North Scituate, R.I.

[73] Assignee: Textron Inc., Providence, R.I.

[21] Appl. No.: 715,681

[22] Filed: Jun. 14, 1991

[51] Int. Cl.[5] ..... A44C 5/00

[52] U.S. Cl. ..... 224/178; 224/164; 224/175; 224/179; 59/79.1; 63/5.1

[58] Field of Search ..... 224/178, 164, 171, 175, 224/179; 63/5.1, 11; 59/82, 84, 80, 79.1; 368/281, 282

[56] References Cited

U.S. PATENT DOCUMENTS 1,694,703 12/1928 Doppenschmitt ..... 63/11
4,805,271 2/1989 Ripley ..... 224/164
4,821,532 4/1989 Jaques et al. ..... 224/178

FOREIGN PATENT DOCUMENTS 1226824 8/1960 France ..... 63/11
1303937 1/1973 United Kingdom .

*Primary Examiner*—Linda J. Sholl
*Attorney, Agent, or Firm*—Samuels, Gauthier & Stevens

[57] ABSTRACT

An elongate wrist band segment has a top row of links overlying a bottom row of links. U-shaped staples connect the links of the top row to the links of the bottom, and springs housed in the links coact with the staples to resiliently accommodate longitudinal expansion and contraction of the band segment. An elongate non-expansible element is received between the top and bottom rows of links and serves to resist longitudinal expansion of the band segment.

6 Claims, 2 Drawing Sheets

NON-EXPANSIBLE WRIST BAND SEGMENT

BACKGROUND OF THE INVENTION

1. Field of the Invention

This invention relates to an improved structure for metallic wrist bands of the type employed as watch bands, identification bracelets, etc.

2. Description of the Prior Art

Metallic wrist bands may be broadly classified as being either of the expansible or non-expansible type. Non-expansible bands usually have a single level construction which typically consists of a braided wire mesh or a single row of pivotally interconnected links. In such single level constructions, the structural and aesthetic functions of the band components are intertwined, thus making it necessary to redesign the entire band structure each time a different ornamental appearance is required.

In contrast, expansible bands typically comprise a multilevel construction which includes: (a) a basic skeleton having a top row of links overlying a bottom row of links, with means for interconnecting the links of both rows in a manner accomodating resilient longitudinal expansion and contraction of the band; and (b)ornamental cover shells applied to the links of the top row. Here, the structural and aesthetic functions are separated, the structural function being satisfied by the basic skeleton which may be viewed as constituting a lower level, and the aesthetic function being satisfied by the of cover shells constituting a lower level. Thus, a variety of different designs can be accommodated by employing the same basic skeleton, with different ornamental appearances being achieved by employing differently designed top shells.

Over the years, consumers have gradually divided themselves into two camps, one preferring non-expansible bands and the other preferring expansible bands. The reasons for such preferences are varied and in many cases entirely subjective. For example, those who prefer non-expansible bands often point to styling considerations, e.g., the somewhat looser feel of the non-expansible band segments coupled with what is perceived to be the stylish appearance of their associated buckles. On the other hand, those who prefer expansible bands point to the relative ease with which such bands can be slipped on and off the wearer's wrist, and the secure and conforming fit resulting from the longitudinally resilient band structure.

The methods and equipment used to manufacture non-expansible bands have traditionally been markedly different from those employed to manufacture expansible bands. For example, because of the above noted intermingling of structural and aesthetic functions, the components of non-expansible bands are usually manufactured in small lots dedicated to specific ornamental designs. Such small lots do not lend themselves to mass production and assembly techniques. Thus, the manufacture of non-expansible bands has traditionally been more labor intensive, resulting in higher costs.

In contrast, and again because of the above noted separation between structural and aesthetic considerations made possible by the multi-level construction of expansible bands, manufacturing and assembly techniques have become highly automated, thus making it possible to achieve lower costs through high volume mass production. As a result, band manufactures also have gradually divided themselves into two camps, i.e., those serving the non-expansible band market and those serving the expansible band market.

SUMMARY OF THE INVENTION

A general objective of the present invention is to modify the structure of the conventional expansible band by subdividing the same into segments coupled one to the other by a buckle or other like device, and by rendering each segment non-expansible, thereby broadening the use of the thus modified band structure into markets previously reserved for traditional non-expansible bands of the more conventional design.

A companion objective of the present invention is to reduce the manufacturing costs of non-expansible bands.

In a preferred embodiment of the invention to be described hereinafter in greater detail, these and other objects and advantages are achieved by subdividing a conventional expansion band into two segments, and by introducing an elongated non-expansible element into each segment. The non-expansible element extends from one end to the other of each respective band segment, and is coactively engageable with the ends of the segment to resist longitudinal expansion thereof.

Preferably, the non-expansible element comprises a relatively thin non-metallic strip inserted between the top and bottom rows of links of the basic skeleton structure.

Various means may be associated with the ends of the non-metallic strip to achieve the necessary coactive engagement with the ends of the band segment. For example, the ends of the non-metallic strip may be heat-sealed to other non-metallic components, or folded over and heat-sealed to provide pockets for receiving pins or the like. Alternatively, metallic clips may be applied to the ends of the non-metallic strip.

BRIEF DESCRIPTION OF THE DRAWINGS

These and other objects, advantages and features will become more apparent as the description proceeds with reference to the accompanying drawings, wherein.

DETAILED DESCRIPTION OF PREFERRED EMBODIMENT

Figure 1:
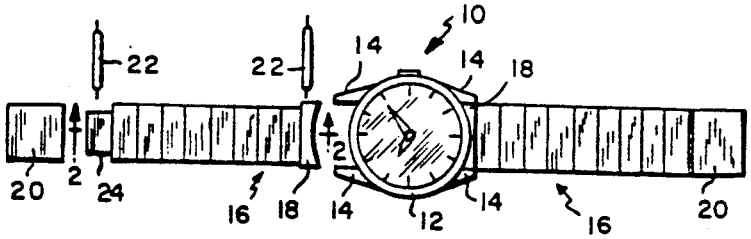
FIG. 1 is a plan view of a wrist watch and band incorporating non-expansible band segments according to the present invention, one of the band segments being shown disassembled from the watch casing and its associated buckle component.
Figure 4:
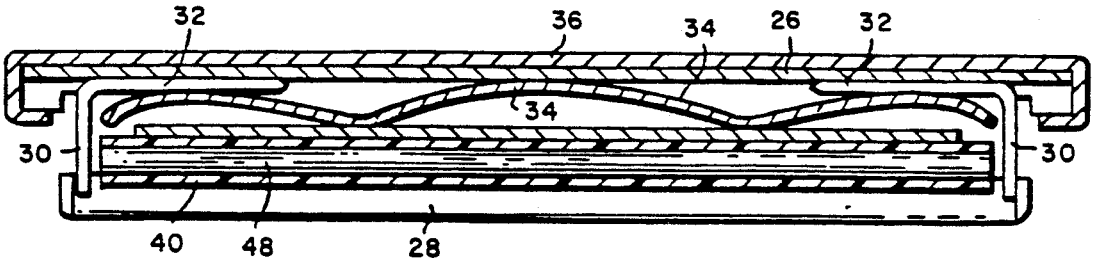
FIGS. 3, 4 and 5 are cross-sectional views taken respectively on lines 3—3, 4—4 and 5—5 of FIG. 2.
Figure 5:
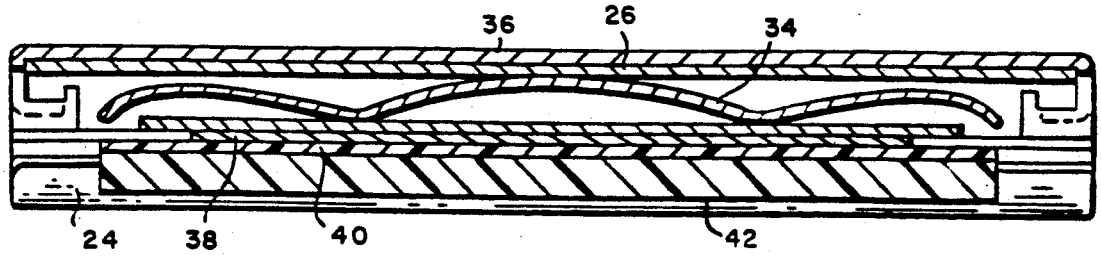
Figure 6:
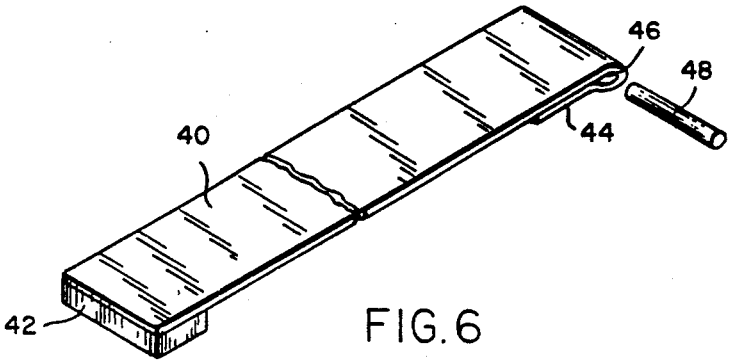
FIG. 6 is a perspective view of a non-expansible element and associated pin.
Figure 2:
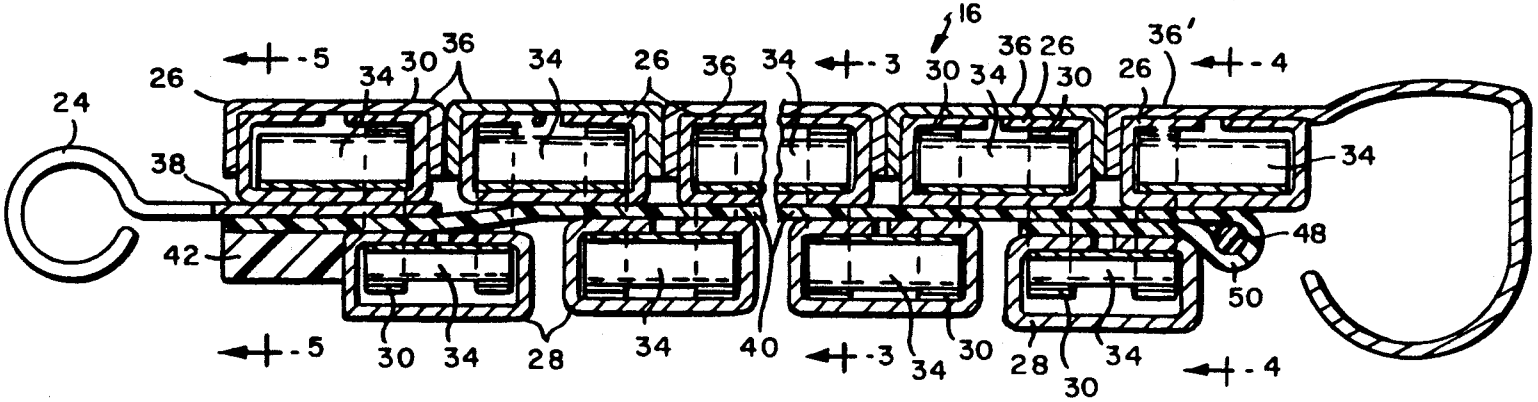
FIG. 2 is a foreshortened sectional view on an enlarged scale taken along line 2—2 of FIG. 1.

Referring initially to FIG. 1, a wrist watch and band assembly is generally indicated at 10. The wrist watch includes the conventional case 12 containing a watch movement, the case having oppositely disposed pairs of lugs 14 spaced apart to receive the ends of two band segments 16. Each band segment has a connector 18 at one end and a buckle component 20 at its opposite end. The end connectors 18 are received between and coupled to the lugs 14 by conventional spring pins 22. The buckle components 20 are similarly connected by spring pins 22 to adapters 2 at the opposite ends of the band segments.

With reference additionally to FIGS. 2–5, it will be seen that the band segments 16 include many of the components typically found in conventional expansible bands. More particularly, each segment includes a basic skeleton structure having a row of top links 26 overlying a row of bottom links 28. The links have somewhat box-like structures, and each bottom link 28 is connected to two adjacent top links 26 by confronting pairs of U-shaped staples 30. The staples have legs 32 (see FIG. 3) protruding into the ends of the links. Leaf springs 34 are housed in the links. The springs 34 act on the staple legs 32 to yieldably contract the band segment in a known manner.

Decorative top shells 36 are secured to the top links 26. The endmost top shell 36' adjacent to the watch case 12 is integrally connected to the end connector 18.

The adapter 24 at the opposite end of the band segment has a planar shank 38 received between the endmost bottom and top links 26, 28 in interlocked engagement with the endmost pair of staples 30. This type of shank/staple engagement is shown in U.S. Pat. No. 4,949,433, the description of which is herein incorporated by reference in its entirety.

As thus described, each band segment is longitudinally expansible and contractible by virtue of the resilient coaction of the springs 34 and staples 30. The present invention centers on the concept of longitudinally immobilizing the basic skeleton structure in order to produce a non-expansible band segment. This is accomplished by introducing an elongate non-expansible element 40 into the skeleton structure. In the preferred embodiment herein chosen for purposes of disclosure, the element 40 comprises a flexible non-metallic strip, typically teflon coated fiberglass or the like. A block 42 of the same material extends transversally across and is heat sealed, glued or otherwise affixed to one end of the element. The opposite end of the element is folded over on itself and heat sealed, glued or otherwise joined as at 44 to thereby form a transversally extending pocket 46.

The element 40 is inserted into one end of the skeleton structure (the left hand end as viewed in FIG. 2) and is longitudinally fed therethrough between the rows of top and bottom links 26, 28. The pocket 46 is flattened to accommodate its passage through the band segment. When the element 40 is fully inserted, the block 42 bears against the adjacent endmost bottom link 28 at one end of the band segment, and the pocket 46 protrudes slightly beyond the endmost bottom link at the opposite end of the band segment. A pin 48 is then inserted into the pocket to thereby produce an enlarged end 50 bearing against the adjacent endmost bottom link 28.

It will thus be seen that the block 42 and enlarged end 50 serve as retainer means which coactively engage links at the ends of the band segment to longitudinally confine the band segment to the length of the element 40, thereby resisting longitudinal expansion of the band segment. The net result is a non-expansible band segment having a basic skeleton structure functioning as an underlying support for the decorative top shells 36 applied to the top links. The design of the top shells may be varied to provide widely varying ornamental styles, without changing the basic skeleton structure.

Figure 7:
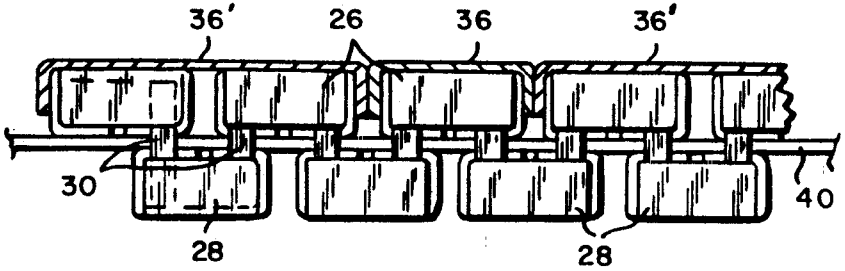
FIG. 7 is a sectional view taken along line 7—7 of FIG. 2 and showing a different top shell arrangement.

In this connection, and with reference to FIG. 7, it will be seen that because the band segment is ultimately rendered non-expansible, some of the top shells can be varied in size as shown at 36' to overlie several top links 26. This further increases the design variations which are possible with band segments according to the present invention.

Figure 8:
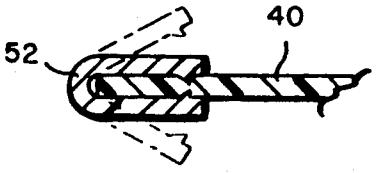
FIG. 8 is a sectional view of an end portion of the non-expansible element with a metallic clip applied thereto.
Figure 3:
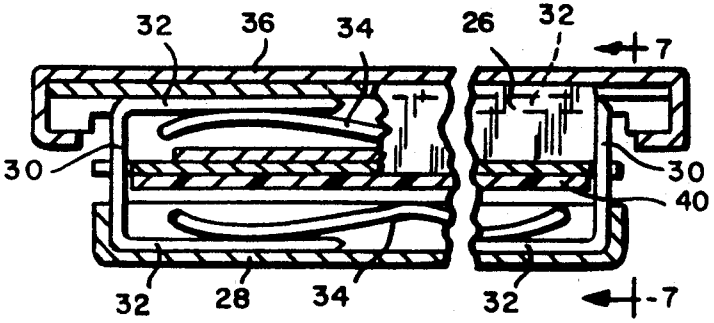

Different retainer means also may be employed at the ends of the element 40. For example, as shown in FIG. 8, metallic clips 52 with toothed surfaces may be crimped onto the element ends.

Although the non-expansible element 40 has been described and illustrated as being of a non-metallic material, it will be understood that other materials such as for example metallic wire meshes, metal strips, etc. also may be utilized as the means for longitudinally resisting expansion of the basic skeleton structure.

It is my intention to cover these and all other modifications to and/or variations of the embodiments herein chosen for purposes of disclosure which do not depart from the spirit and scope of the invention as defined by the appended claims.

I claim:

1. An elongate wrist band segment comprising: a top row of links overlying a bottom row of links; U-shaped staples connecting the links of said top row to the links of said bottom row; spring members housed in said links and coacting with said staples to resiliently accommodate longitudinal expansion and contraction of said band segment; an elongate non-expansible element located within said band segment between said bottom and top rows of links extending from one end to the other of said band segment; and retainer means at the ends of said element, said retainer means being coactively engageable with links at the ends of said band segment to resist said longitudinal expansion.

2. The wrist band segment of claim 1 wherein said links are metallic and said element is non-metallic.

3. The wrist band segment of either claims 1 or 3 wherein said retainer means comprises clip members applied to the ends of said element.

4. The wrist band segment of claim 1 wherein said non-expansible element comprises a planar strip located between said bottom and top rows of links.

5. The wrist band segment of claim 1 further comprising shell members secured to and overlying the links of said top row.

6. The wrist band segment of claim 5 wherein at least some of said shell members are secured to and overlie more than one of the links of said top row.

* * * * *